US006012180A

United States Patent [19]

Williams

[11] Patent Number: 6,012,180

[45] Date of Patent: Jan. 11, 2000

[54] TOILET SEAT LIFTING DEVICE

[76] Inventor: Larry T Williams, 3517 Eve Dr., Columbia, S.C. 29210

[21] Appl. No.: 09/093,507

[22] Filed: Jun. 8, 1998

[51] Int. Cl.[7] ..... A47K 13/12

[52] U.S. Cl. ..... 4/241; 4/246.1; 16/DIG. 36

[58] Field of Search ..... 4/241, 246.1, 248; 16/72, DIG. 36, DIG. 10, 401

[56] References Cited

U.S. PATENT DOCUMENTS

| | | |
|---|---|---|
| 622,383 | 4/1899 | O'Brien . |
| 1,045,927 | 12/1912 | Zeleny et al. . |
| 1,529,656 | 3/1925 | Kornhauser . |
| 1,681,277 | 8/1928 | Booth . |
| 2,164,116 | 6/1939 | Lincoln . |
| 2,814,049 | 11/1957 | Mercur . |
| 2,877,469 | 3/1959 | Johnson . |
| 3,653,077 | 4/1972 | Warnberg . |
| 4,195,372 | 4/1980 | Farina . |
| 4,402,092 | 9/1983 | Smallwood . |
| 4,965,890 | 10/1990 | Fischer . |
| 5,642,532 | 7/1997 | Morant . |

*Primary Examiner*—Charles R. Eloshway
*Attorney, Agent, or Firm*—Michael A Mann Nexsen Pruet Jacobs & Pollard LLP

[57] ABSTRACT

A pair of compound leaf springs are formed to hold a commode seat in the up position. The leaf springs have a primary curve for spring lifting power, a second curve to reduce friction between the seat and spring when the seat is lowered, and a third curve to act as a spring washer to hold the leaf spring in place between the seat and commode. By holding the seat in the up position unless a user wishes to lower it, the seat is less apt to be soiled when the commode is used for urination.

13 Claims, 1 Drawing Sheet

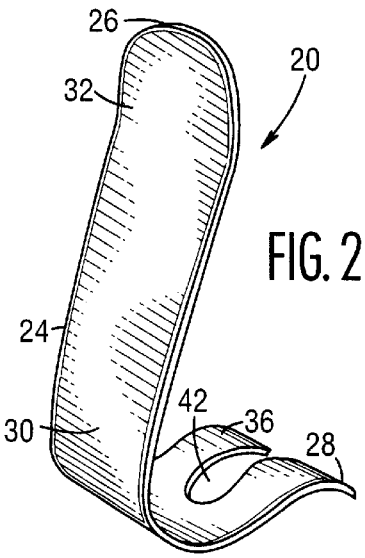
FIG. 2
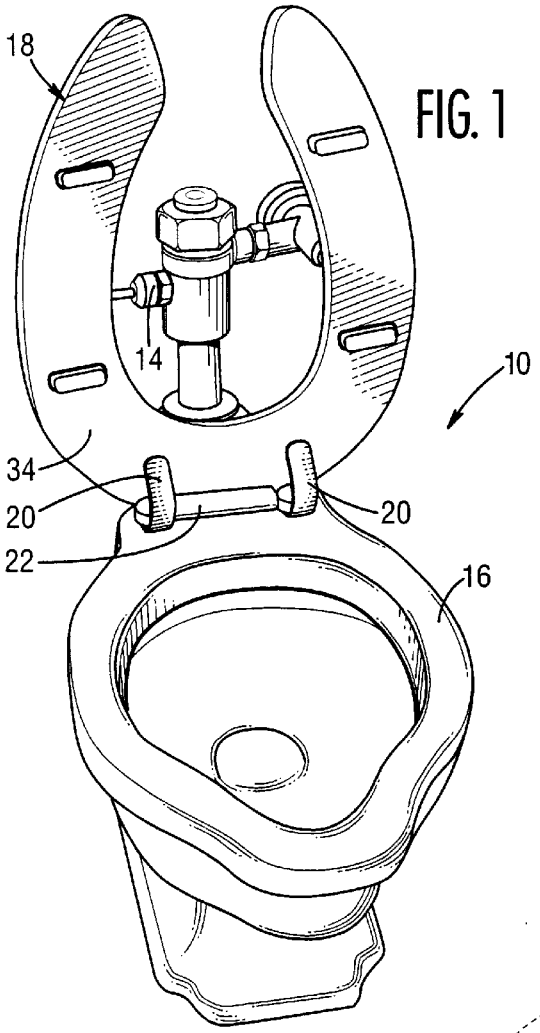
FIG. 1
FIG. 3
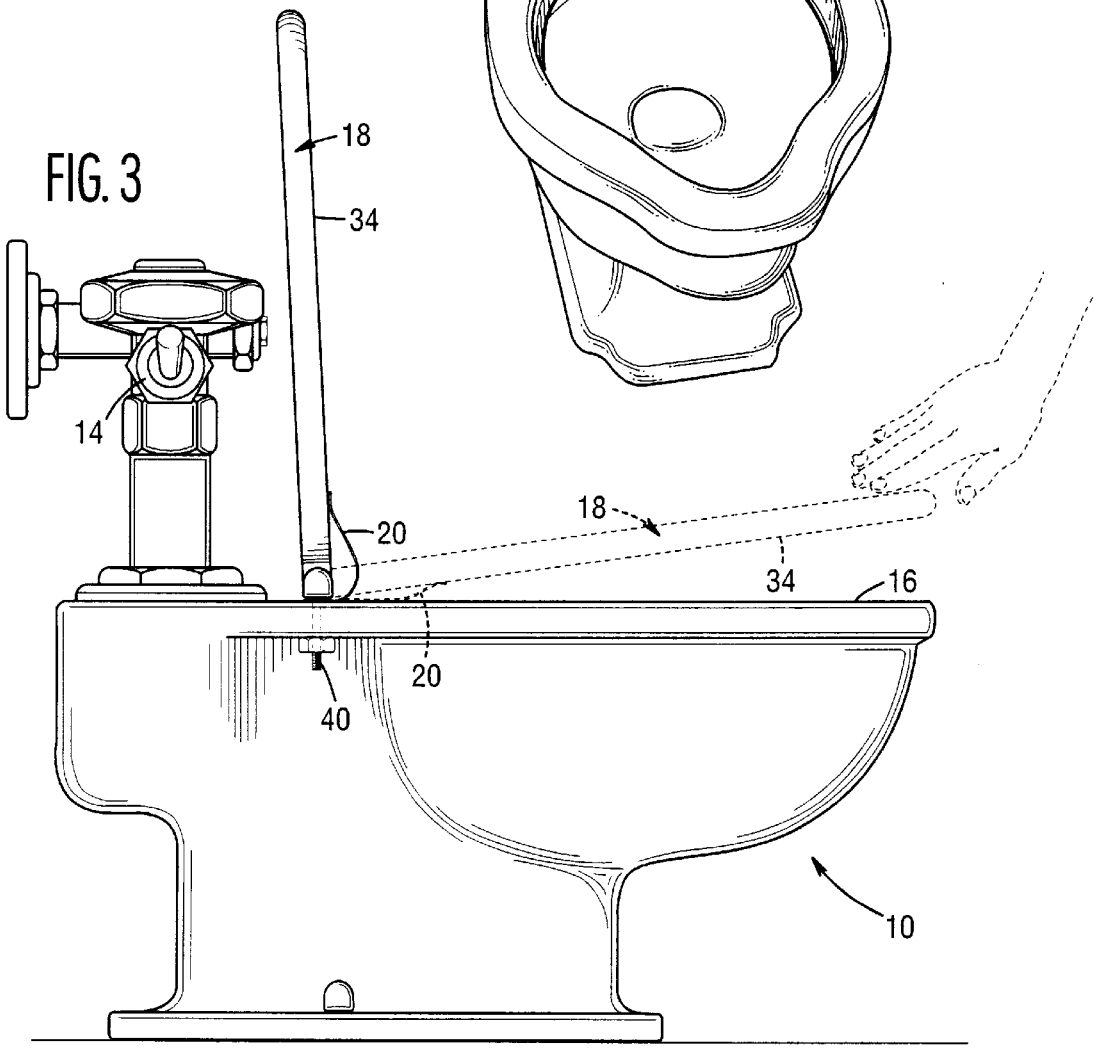

TOILET SEAT LIFTING DEVICE

FIELD OF THE INVENTION

The present invention relates to standard flushdown commodes. In particular, the present invention relates to devices for urging the seat of a commode to the "up" position.

BACKGROUND OF THE INVENTION

The standard flush commode has not changed in its basic function for scores of years. The commode includes a tank filled with water for flushing or other pressurized water source, a bowl in fluid communication with a sewer system for receiving the wastes, a seat hingedly attached to the bowl and, sometimes, a lid hingedly attached to the bowl or seat to cover the seat. In commercial toilets, there is usually no lid.

The commode is used in two ways. People sit on the seat or, in the case of men, they stand at the commode with the seat up and urinate into the bowl from a standing position.

In public toilets, where the commodes are used by a variety of people each with different standard of person hygiene, commodes can quickly become unsanitary. In men's rooms, for example, not everyone has the courtesy to lift the seat before urinating into the bowl. As a consequence, the seat itself becomes quickly fouled and unusable.

In some public restrooms, paper seat covers are provided that provide a sanitary barrier for the user. If the seat is wet, however, these covers are inadequate. Furthermore, they are awkward and add to the burden on sewer system.

Others have created devices for urging the seat of a commode into either the open or closed position. Most of these require a major change in the hinging of the commode and are complicated. None is easily installed onto existing commodes. Therefore, there remains a need for a better way to keep toilet seats clean.

SUMMARY OF THE INVENTION

The present invention is a pair of leaf springs of particular shape that can be easily inserted between the seat of a commode and the bowl and that will urge the seat to the up position. The springs, although strong enough to lift a seat, are resilient enough to allow a user to push the seat into the down position when desired.

The two leaf springs are identical and have three curves. A primary curve is formed to urge the seat to the up position. The more the primary curve is straightened, the greater the spring force. The second curve is near the end of the leaf spring that engages the toilet seat. This second curve allows the seat and the spring to slide with respect to each other as the seat is moved between the up and down positions. The third curve serves as a lock washer and is a slight curve near the end of the leaf spring that fits under the seat and on the commode, where the leaf springs are held in place by the seat bolts. As the bolts are tightened, this third curve flattens and their spring forces act to hold the leaf spring in place.

A feature of the present invention is the use of leaf springs rather than coil springs or other mechanisms. Leaf springs are very inexpensive to manufacture and engineer, they can "nest" for shipping in quantity, and are themselves easy to clean.

Another feature of the present invention is the use of compound curves in the leaf springs to achieve three different actions: lifting power, friction reduction and locking.

Other features and advantages of the present invention will be apparent to those skilled in the art from a careful reading of the Detailed Description of Preferred Embodiments accompanied by the following drawings.

BRIEF DESCRIPTION OF THE DRAWINGS

In the drawings,

FIG. 1 is a perspective view of a commode having a toilet seat lifting device according to a preferred embodiment of the present invention;

FIG. 2 is a detailed perspective view of the lifting device according to a preferred embodiment of the present invention; and FIG. 3 is a side elevational view of a commode having a toilet seat lifting device according to a preferred embodiment of the present invention.

DETAILED DESCRIPTION OF PREFERRED EMBODIMENTS

The present invention is a pair of leaf springs for urging a commode seat in the up position. The commode seat is in the up position when the seat has been lifted far enough so that it will not fall back down onto the bowl without assistance. It is in the down position when it is resting on the rim of the toilet bowl. The present invention urges the seat to the up position at all times and will move it to the up position unless a sufficient force is applied in the opposing direction, such as when a user sits on the seat or pushes it down with his hand.

FIG. 1 illustrates in perspective a commode with the present leaf springs. The commode, generally indicated by the reference number 10, that is connected to a source of water, a flush valve 14, a bowl 16 and a seat 18. Leaf springs 20 are seen fitted between bowl 16 and seat 18, which is in the up position. Seat 18 is attached to bowl 16 by a hinge 22.

FIG. 3 is a side elevational view of the commode of FIG. 1 with leaf springs 20. In phantom lines, seat 18 is shown being pushed toward the down position. Leaf spring 20 is shown in profile in FIG. 3 and in perspective in FIG. 2, where its three curves can be easily seen. Leaf spring has a central portion 24, a first end 26 and a second end 28.

First curve 30 is formed in central portion 24 of leaf spring 20 and is concave toward hinge 22. First curve 30 of spring 20 is relieved when seat 18 is up and is loaded when seat is down. Second curve 32 is formed near first end 26 and is convex facing seat so that a smooth, curved portion of leaf spring 20 engages the underside 34 of seat 18. As seat 18 is raised and lowered, second curve 32 must be able to slide with respect to underside 34 of seat 18. By presenting a smooth curve, friction between seat 18 and spring 20 is minimized and the sliding of the two with respect to each other does not mar underside 34.

Third curve 36 is formed near second end 28 of leaf spring 20 and is a slight curve that may be concave toward commode 16 or convex. Third curve 36, the equivalent of a spring or lock washer, is loaded when commode bolts 40 are tightened with spring 20 between seat 18 and commode 16. Preferably leaf spring 20 has a cut out portion 42 to straddle commode bolts 40, as best seen in FIG. 2.

To install leaf springs 20, seat 18 is placed in the up position and then commode bolts 40 are both loosened by a sufficient amount to enable the user to slide second end 28 between commode 16 and seat 18 with first curves 30 oriented to be concave toward hinges 22. Then bolts 40 are tightened. Commode 10 is then ready for use.

Leaf springs 20 are formed by taking flat stock of a strong resilient and preferably non-corrosive material such as carbon steel coated with polyurethane or stainless steel and incorporating first, second and third curves. The strength of the steel in terms of its ability as a leaf spring to lift commode seat 18, will depend on the type of material, its width and thickness as well as the weight of commode seat 18 and the location of second curve 32 with respect to the commode hinge 22. This determination can be made by those skilled in the arts of material properties by simple calculations or by a very modest degree of experimentation.

Instead of third curve 36, the second end 28 may be modified by changing the relative orientation of leaf spring 20 on either side of cutout portion 42 so that one "leg" is "up" and one "leg" is "down". Tightening commode bolts 40 onto the two "legs" on either side of cutout portion 42 would also act as a lock washer to lock leaf spring in place.

Some commodes have different arrangements for hingedly attaching seat 18. For example, some seats attach at a central hinge. In this case instead of two smaller leaf springs according to the foregoing preferred embodiment, a single wider or stronger leaf spring would be equivalent.

It will be apparent to those skilled in the art that many other modifications and substitutions can be made to the foregoing preferred embodiments without departing from the spirit and scope of the present invention, defined by the appended claims.

What is claimed is:

1. A device for use in urging the seat of a commode to the up position for use by a male when urinating, said device comprising a pair of leaf springs, each leaf spring having a central portion and a first end and an opposing second end, each leaf spring of said pair of leaf springs being concave at said central portion and having a cutout portion near said second end, the degree of concavity at said central portion being such that said pair of leaf springs biases the seat to the up position so that a male can urinate into the commode without interference with the seat, said concave central portion arranged such that it opens to face the underside of the seat.

2. The device as recited in claim 1, wherein said second end is curved to act as a spring washer.

3. The device as recited in claim 1, wherein said first end is curved in a direction opposite that of said central portion.

4. The device as recited in claim 2, wherein said first end is curved in a direction opposite that of said central portion.

5. The device as recited in claim 1, wherein said device is made of carbon steel coated with polyurethane.

6. The device as recited in claim 1, wherein said central portions of said leaf springs are dimensioned and made of a material adapted to be strong enough to urge said seat to an up position but to allow said seat to be pushed to the down position.

7. A device for use in urging the seat of a commode to the up position, said device comprising a pair of leaf springs, each leaf spring having a central portion and a first end and an opposing second end, said each leaf spring being concave at said central portion and convex at said first end, each said leaf spring of said pair of leaf springs having a lock washer formed in said second end, the degree of concavity at said central portion being such that said pair of leaf springs biases the seat to the up position so that a male can urinate into the commode without interference with the seat, said concave central portion arranged such that it opens to face underside of the seat.

8. The device as recited in claim 7, wherein said device is made of a resilient non-corrosive material.

9. The device as recited in claim 7, wherein said pair of leaf springs is formed so that, when attached to a commode, said pair of leaf springs is loaded when said seat is lowered and relieved when said seat is lifted.

10. An improvement in a commode having a bowl, a seat, and a hinge for hingedly attaching said seat to said bowl, wherein the improvement comprises:

a pair of leaf springs inserted between said seat and said bowl and oriented so that said pair of leaf springs is loaded by lowering said seat and relieved by lifting said seat, each leaf spring of said pair of leaf springs has a central portion and a first end and an opposing second end, and wherein each leaf spring of said pair of leaf springs has two curves formed therein, a first curve formed in said central portion and oriented to be concave toward said hinge and a second curve formed to be convex toward said seat in said first end, the degree of concavity at said central portion being such that said pair of leaf springs biases the seat to the up position so that a male can urinate into the commode without interference with the seat, said concave central portion arranged such that it opens to face the underside of the seat.

11. The improvement of claim 10, wherein said second end inserted between said seat and said bowl.

12. The improvement of claim 10, wherein each leaf spring of said pair of leaf spring has a central portion and a first end and an opposing second end, and wherein each leaf spring of said pair of leaf springs has two curves formed therein, a first curve formed in said central portion and oriented to be concave toward said hinge and a second curve formed to be convex toward said seat in said first end.

13. The improvement of claim 10, wherein each leaf spring of said pair of leaf springs has a third curve formed in said second end, said second end inserted between said seat and said bowl.

* * * * *